US007740344B2

(12) United States Patent
Takahashi et al.

(10) Patent No.: US 7,740,344 B2
(45) Date of Patent: Jun. 22, 2010

(54) LIQUID DROPLET JETTING APPARATUS AND INK-JET PRINTER

(75) Inventors: Yoshikazu Takahashi, Nagoya (JP); Tatsuya Shindo, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 903 days.

(21) Appl. No.: 11/591,102

(22) Filed: Nov. 1, 2006

(65) Prior Publication Data

US 2007/0103519 A1 May 10, 2007

(30) Foreign Application Priority Data

Nov. 2, 2005 (JP) ..... 2005-319455

(51) Int. Cl.
*B41J 2/045* (2006.01)

(52) U.S. Cl. ..... 347/70; 347/65

(58) Field of Classification Search ..... 347/20, 347/40–43, 47, 67–71
See application file for complete search history.

(56) References Cited

U.S. PATENT DOCUMENTS 6,685,299 B2 2/2004 Hirota
6,712,454 B2 * 3/2004 Okuda ..... 347/65

FOREIGN PATENT DOCUMENTS

| | | |
|---|---|---|
| JP | 61016863 | 1/1986 |
| JP | 2002-355962 | 12/2002 |
| JP | 2003127354 | 5/2003 |

* cited by examiner

*Primary Examiner*—Thinh H Nguyen
(74) *Attorney, Agent, or Firm*—Eugene LeDonne; Joseph W. Treloar; Frommer Lawrence & Haug LLP

(57) ABSTRACT

An ink-jet head includes a plurality of pressure chambers arranged in a paper feeding direction, and two manifold channels extended along the paper feeding direction. The manifold channel includes a first area which communicates with the pressure chambers, and a second area which is connected to an end of the first area, on a side opposite to an ink inflow port, and communicates with a plurality of dummy nozzles. A width of the second area is more than a width of the first area, and an acoustic capacitance of the second area, per unit length in the paper feeding direction is higher than an acoustic capacitance of the first area, per unit length in the paper feeding direction. Accordingly, it is possible to attenuate efficiently a pressure wave in the manifold channel.

18 Claims, 9 Drawing Sheets

LIQUID DROPLET JETTING APPARATUS AND INK-JET PRINTER

CROSS REFERENCE TO RELATED APPLICATION

The present application claims priority from Japanese Patent Application No. 2005-319455, filed on Nov. 2, 2005, the disclosure of which is incorporated herein by reference in its entirety.

BACKGROUND OF THE INVENTION

1. Field of the Invention

The present invention relates to a liquid droplet jetting apparatus which jets a liquid droplet from a discharge port, and an ink-jet printer.

2. Description of the Related Art

Among ink-jet heads (liquid droplet jetting apparatuses) which jet an ink from a nozzle by applying a pressure to the ink in a pressure chamber, in certain types of ink-jet heads, a pressure wave which is generated in the pressure chamber when the pressure is applied to the ink in the pressure chamber, and propagated to a common liquid chamber communicating with the pressure chamber is attenuated in the common liquid chamber, and jetting characteristics of the ink are suppressed from being uneven by preventing the pressure wave from being propagated to another pressure chamber. For example in an ink-jet recording head (ink-jet head) described in Japanese Patent Application Laid-open No. 2003-127354 (FIG. 3 ), a plurality of pressure generating chambers (pressure chambers) which communicate with nozzles, communicates with an ink storage chamber (common liquid chamber) via an ink supply channel, and a recess is formed in a head case at a portion facing the ink storage chamber. Further, a portion of a vibration plate, overlapping with the recess acts as a damper which dissipates a pressure fluctuation (which attenuates a pressure wave) in the ink storage chamber.

SUMMARY OF THE INVENTION

However, in an ink-jet head described in Japanese Patent Application Laid-open No. 2003-127354, and reduction in size of the head, it is necessary to reduce a size of an ink storage chamber to realize a high densification. Accordingly, a recess also becomes small, and an area of a portion of a vibration plate, which acts as a damper is decreased. Therefore, there is a fear that a pressure wave cannot be attenuated sufficiently.

An object of the present invention is to provide a liquid droplet jetting apparatus and an ink-jet printer which are capable of attenuating assuredly a pressure wave.

According to a first aspect of the present invention, there is provided a liquid droplet jetting apparatus which jets a liquid, including a channel unit including a common liquid chamber which is long in an extending direction and which has a first area and a second area, the first area having a liquid inflow port through which the liquid flows in, and a plurality of first connection ports through which the liquid flows out, the second area having a second connection port which is formed on a side opposite to the liquid inflow port with respect to the first connection ports; a plurality of pressure chambers communicating with the common liquid chamber; a plurality of first discharge ports communicating with the pressure chambers; a second discharge port communicating with the common liquid chamber; a plurality of first individual liquid channels each ranging from one of the first connection ports of the common liquid chamber up to one of the first discharge ports via one of the pressure chambers; and a second individual liquid channel ranging from the second connection port up to the second discharge port; and an energy imparting mechanism which imparts a discharge energy to the liquid in the pressure chamber; and an acoustic capacitance of the second area, per unit length along a direction in which the common liquid chamber is extended, is greater than an acoustic capacitance of the first area, per unit length.

In this case, since the acoustic capacitance per unit length of the second area is greater than the acoustic capacitance per unit length of the first area, it is possible to attenuate efficiently the pressure wave in the second area. Consequently, it is possible to prevent a generation of a cross-talk in which the pressure wave which is generated when the discharge energy is imparted to the liquid in the pressure chamber by the energy imparting mechanism and propagated to the common liquid chamber, is propagated to another pressure chamber, and jetting characteristics of a liquid droplet from the discharge port are changed.

Moreover, in the liquid droplet jetting apparatus described in the present invention, a length of the second area in a direction orthogonal to the extending direction may be greater than a length of the first area in the direction orthogonal to the extending direction in a plane parallel to a bottom surface of the common liquid chamber. Accordingly, by increasing the length of the second area in the direction orthogonal to the direction of extension of the common liquid chamber in the plane parallel to the bottom surface of the common liquid chamber, it is possible to increase the acoustic capacitance per unit length in the direction of extension of the second area.

Moreover, in the liquid droplet jetting apparatus of the present invention, the second individual liquid channel may overlap entirely with the second area of the common liquid chamber in a plane parallel to a bottom surface of the common liquid chamber. Accordingly, when viewed from a direction orthogonal to the direction of extension in the plane parallel to the bottom surface of the common liquid chamber, since the second individual liquid channel is not formed on an outer side farther than the second area, it is possible to increase the length of the second area in the direction orthogonal to the direction of extension, in the plane parallel to the bottom surface of the common liquid chamber. Consequently, it is possible to increase the acoustic capacitance per unit length of the second area.

Moreover, the liquid droplet jetting apparatus of the present invention a wall surface which defines the second area of the common liquid chamber may be formed by a first thin-walled portion, and the channel unit further includes a first damper chamber, of which a part of a wall surface may be formed by the first thin-walled portion, and which has a stiffness lower than a stiffness of the first thin-walled portion. Accordingly, by forming the wall surface of the second area by the first thin-walled film, it is possible to increase the acoustic capacitance per unit length in the direction of extension of the second area. Further, when the length of the second area in the direction orthogonal to the direction of extension, in the plane parallel to the bottom surface of the common liquid chamber, is increased, since it is possible to increase a length of the first thin-walled film and the first damper chamber in this direction, the acoustic capacitance per unit length in the direction of extension of the second area is increased further. Here, the thin-walled film is a plate member having a thin wall. Moreover, the stiffness of the first damper chamber lower than the stiffness of the first thin-walled film means that a stiffness of a substance which is filled in the first damper chamber (such as a gas like air, a liquid like ink, or a sponge member) is lower than the thickness of the first thin-walled film.

In the liquid droplet jetting apparatus of the present invention, a wall surface, of the second area, facing the first thin-walled portion may be formed by a second thin-walled portion, and the channel unit further may include a second damper chamber, of which a part of a wall surface is formed by the second thin-walled portion, and which has a stiffness lower than a stiffness of the second thin-walled portion. Accordingly, by forming the wall surface facing the first thin-walled film of the second area, by the second thin-walled film, it is possible to increase the acoustic capacitance per unit length in the direction of extension of the second area.

Moreover, in the liquid droplet jetting apparatus of the present invention, a length of the second area in the direction orthogonal to a bottom surface of the common liquid chamber may be greater than a length of the first area. Accordingly, it is possible to increase the acoustic capacitance per unit length in the direction of extension of the second area.

In the liquid droplet jetting apparatus of the present invention, a cross-sectional area of the second area may be greater than a cross-sectional area of the first area with respect to a surface orthogonal to the extending direction. In this case, it is possible to increase the acoustic capacitance of the second area, per unit length in the direction of extension to be greater than the acoustic capacitance per unit length of the first area, and to reduce the cross-talk.

In the liquid droplet jetting apparatus of the present invention, the common liquid chamber may include a first liquid chamber and a second liquid chamber, the first liquid chamber and the second liquid chamber each having the first area and the second area; and the channel unit may further include a connecting channel which connects the second area of the first liquid chamber and the second area of the second liquid chamber at a portion of each of the first chamber and the second chamber on a side opposite to the liquid inflow port with respect to the first area. Accordingly, the second areas being connected by the connecting channel, it is possible to attenuate the pressure wave in the second area of the first liquid chamber and the second area of the second liquid chamber.

In the liquid droplet jetting apparatus of the present invention, a wall surface of the connecting channel may be formed by a third thin-walled portion, and the channel unit may further include a third damper chamber, of which a part of a wall surface is formed by the third thin-walled portion, and which has a stiffness lower than a stiffness of the third thin-walled portion. Accordingly, by forming the wall surface of the connecting channel by the third thin-walled film, it is possible to increase further the acoustic capacitance per unit length in the direction of extension of the connecting channel.

Moreover, in the liquid droplet jetting apparatus of the present invention, the energy imparting mechanism may include a piezoelectric layer facing the pressure chamber, and pairs of electrodes which apply an electric field to the piezoelectric layer to change a volume of the pressure chambers, respectively. Accordingly, it is possible to let the energy imparting mechanism to have a simple structure which includes the piezoelectric layer facing the pressure chamber, and at least a pair of electrodes, which applies an electric field to the piezoelectric layer.

In the liquid droplet jetting apparatus of the present invention, the second discharge port may be a dummy discharge port which jets no droplet of the liquid. In this case, for example, the second individual channel does not include the pressure chamber, and the discharge port of the second individual channel does not discharge a liquid droplet. Consequently, since in the second area, the connection port related to the first individual liquid channels which discharge the liquid droplet is not formed, but the connection port related to the second individual liquid channels which do not discharge the liquid droplet is formed, a degree of freedom of designing for the second area is higher as compared to a degree of freedom of designing for the first area, and it is easy to form a structure having a high acoustic capacitance. Furthermore, when the liquid is flowed into the common liquid chamber from the liquid inflow port, farther the area of the common liquid chamber from the liquid inflow port, the liquid is hardly flowed to that area, and when the connection port related to the first individual liquid channel is formed in this area, there is a possibility that an air bubble is flowed into the first individual liquid channel, and the jetting characteristics of the liquid droplet from the discharge port is changed. However, in a case of the present invention, since the connection port with the second individual liquid channel communicating with the dummy discharge port which is a discharge port which does not jet the liquid droplet is formed at a position away from a liquid inlet (inflow port) of the common liquid chamber, the air bubble is discharged easily, and the air bubble is hardly flowed into the first individual liquid channels. Furthermore, since a plurality of connecting ports which communicate with the discharge ports of the plurality of first individual liquid channels which jet the liquid droplet are not formed near an end portion on a side opposite to the ink inflow port which is susceptible to be affected by the pressure wave in the common liquid chamber, the cross-talk hardly occurs.

In the liquid droplet jetting apparatus of the present invention, a length of the second area with respect to a direction orthogonal to the extending direction may be same as a length of the first thin-walled portion in a plane parallel to a bottom surface of the common liquid chamber. Moreover, a length of the second area with respect to a direction orthogonal to the extending direction may be same as a length of the second thin-walled portion in a plane which is parallel to a bottom surface of the common liquid chamber. Furthermore, a length of the first thin-walled portion with respect to a direction orthogonal to the extending direction may be same as the length of the second thin-walled portion in the plane parallel to the bottom surface of the common liquid chamber. In any of the cases, it is possible to attenuate efficiently the pressure wave in the second area.

According to a second aspect of the present invention, there is provided an ink-jet printer which prints by jetting an ink on an object, including a transporting mechanism which transports an object in a predetermined direction, and an ink-jet head including a channel unit which includes a common liquid chamber which is long in a extending direction, and which has a first area and a second area, the first area having a liquid inflow port through which the liquid flows in, and a plurality of first connection ports through which the liquid flows out, the second area having a second connection port which is formed on a side opposite to the liquid in flow port with respect to the first connection ports; a plurality of pressure chambers communicating with the common liquid chamber; a plurality of first discharge ports communicating with the pressure chambers; a second discharge port communicating with the common liquid chamber; a plurality of first individual liquid channels each ranging from one of the first connection ports of the common liquid chamber up to one of the first discharge ports via one of the pressure chambers; and a second individual liquid channel ranging from the second connection port up to the second discharge port; and an energy imparting mechanism which imparts a discharge energy to the liquid in the pressure chamber; and an acoustic capacitance of the second area per unit length along the extending direction is greater than an acoustic capacitance of the first area per unit length.

According to the second aspect of the present invention, it is possible attenuate efficiently a pressure wave which is propagated in the common liquid chamber, by forming the second area having a greater acoustic capacitance, and to reduce the cross-talk.

DETAILED DESCRIPTION OF THE PREFERRED EMBODIMENTS

An exemplary embodiment of the present invention will be described below while referring to the accompanying diagrams. This embodiment is an example in which a liquid droplet jetting apparatus of the present invention is applied to an ink-jet head which jets ink from a nozzle, and which performs recording on a recording paper.

Figure 1:
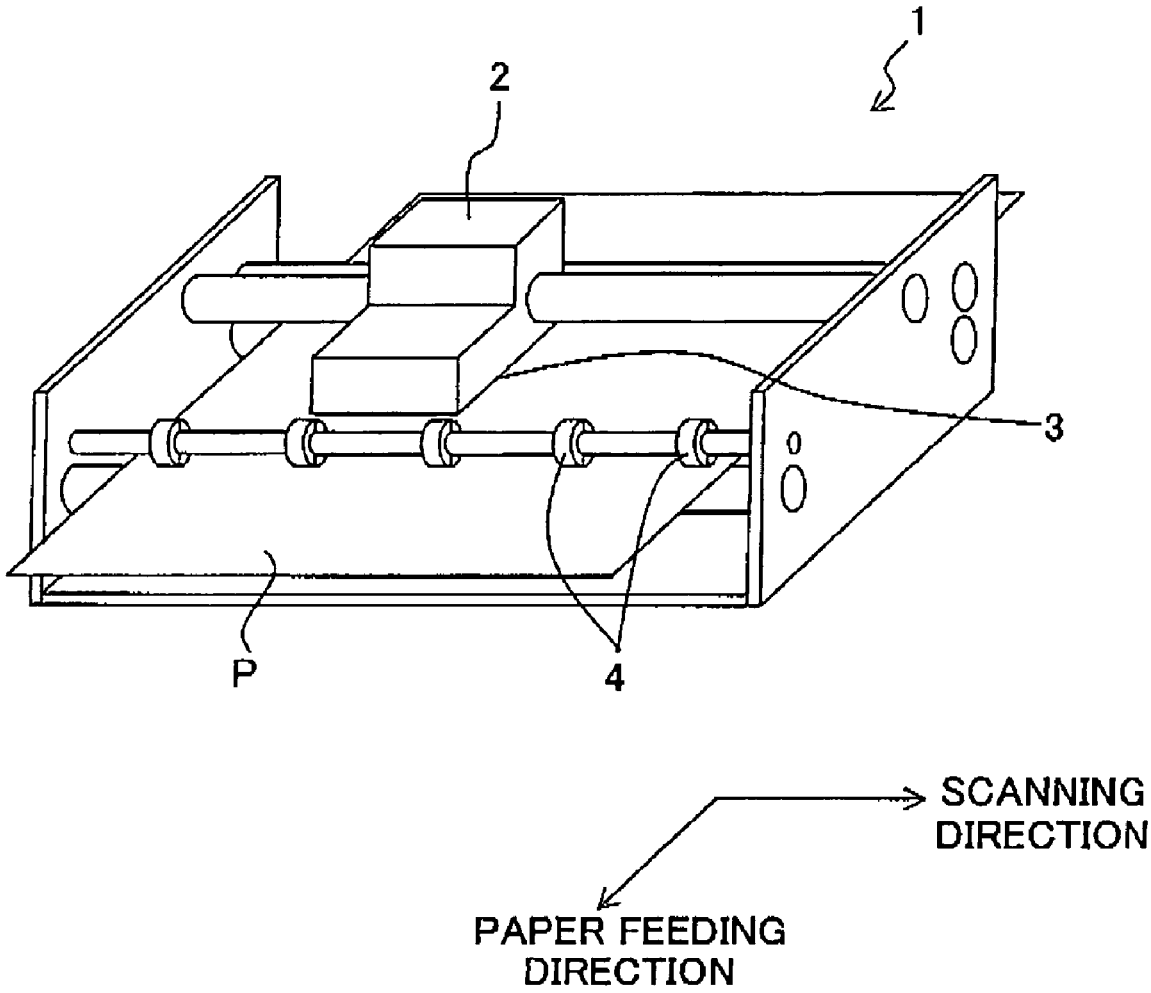
FIG. 1 is a schematic perspective view of an ink-jet printer according an embodiment of the present invention.

FIG. 1 is a schematic perspective view of an ink-jet printer according to the embodiment of the present invention. As shown in FIG. 1, an ink-jet printer 1 includes a carriage 2 which is movable in a scanning direction (left and right direction) in FIG. 1, an ink-jet head of serial type which is installed on the carriage 2, and discharges ink onto a recording paper P, and paper transporting rollers 4 which carry the recording paper P in a forward direction (paper feeding direction) in FIG. 1. The ink-jet head 3 moves integrally with the carriage 2 in the scanning direction, and prints an image on the recording paper by jetting the ink from nozzles 15 which are provided in a lower surface of the carriage 2. Moreover, the recording paper P with an image printed thereon by the ink-jet head 3 is discharged in the paper feeding direction by the paper transporting rollers 4.

Figure 2:
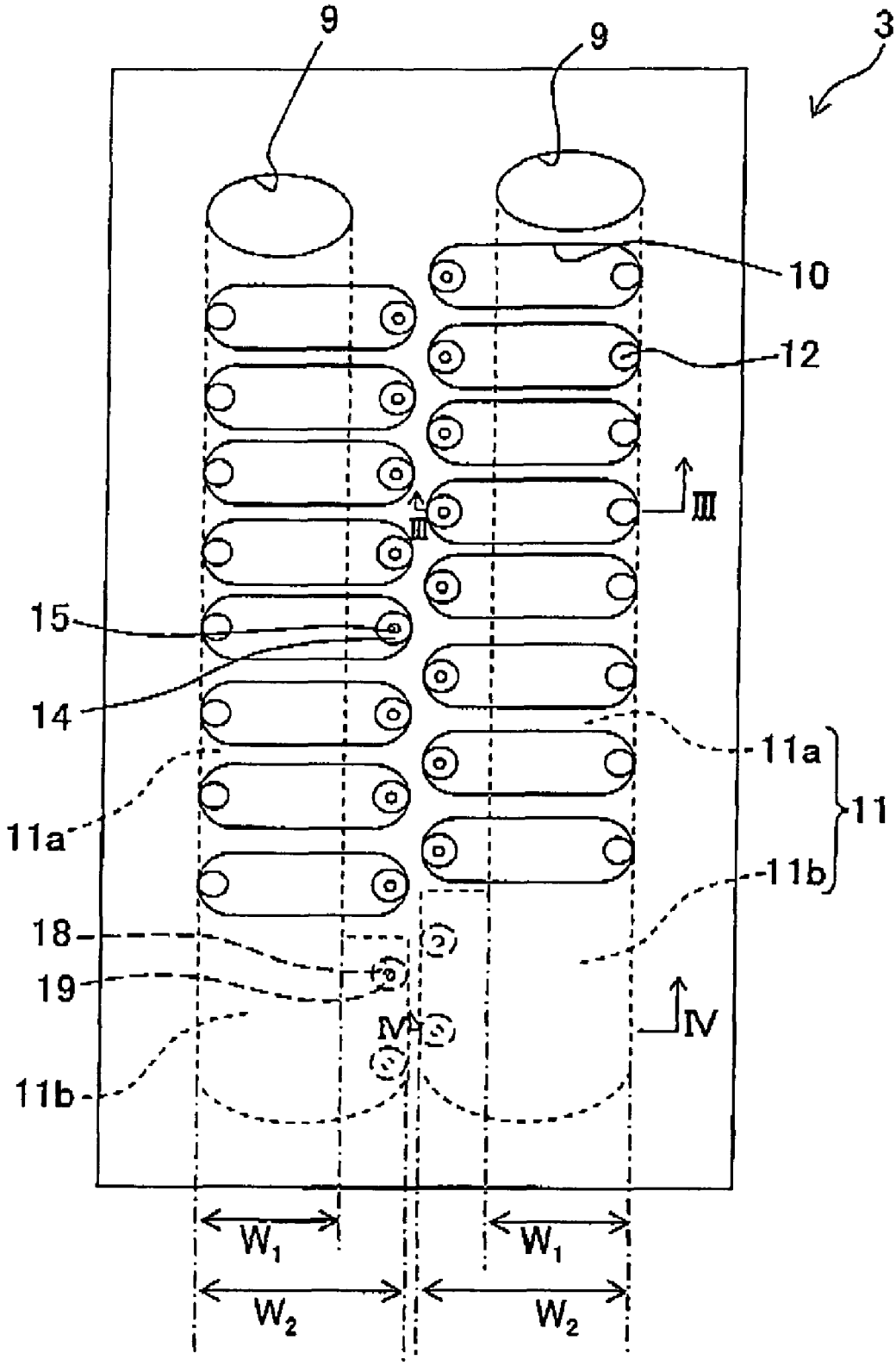
FIG. 2 is a plan view of the ink-jet head in FIG. 1.

Next, the ink-jet head 3 will be described with reference to FIG. 2 to FIG. 4. In FIG. 2, the piezoelectric actuator 32 which will be described later is omitted (not shown).

Figure 3:
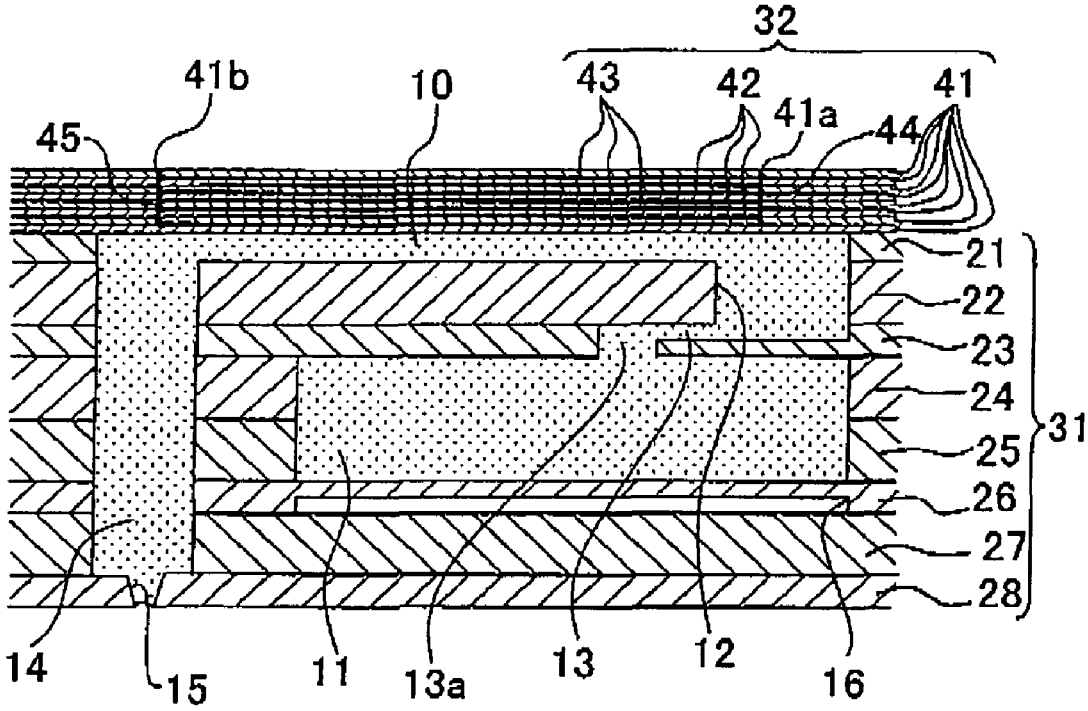
FIG. 3 is a cross-sectional view taken along a line III-III in FIG. 2.
Figure 4:
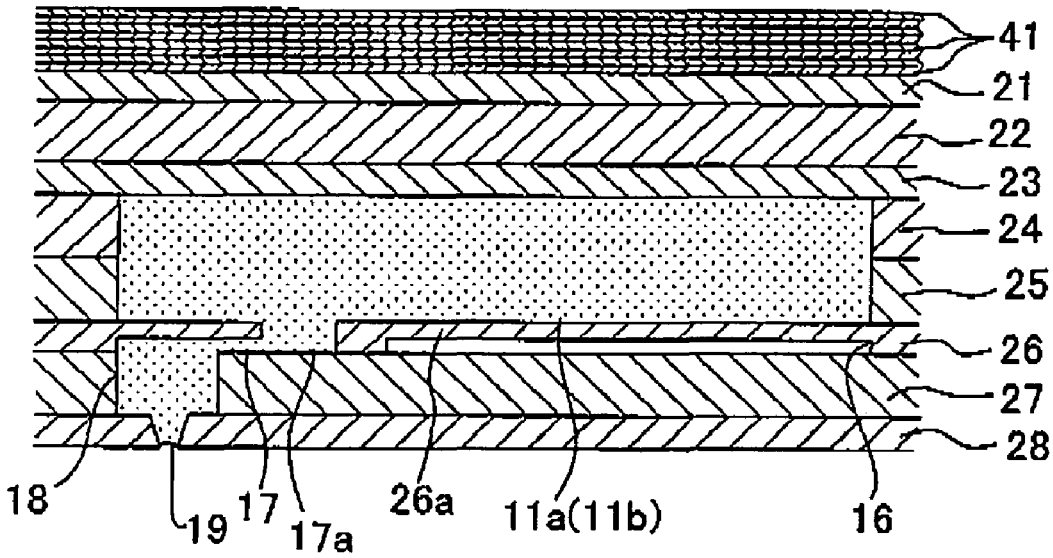
FIG. 4 is a cross-sectional view taken along a line IV-IV in FIG. 2.

As shown in FIG. 2 to FIG. 4, the ink-jet head 3 includes a channel unit 31 in which ink channels such as pressure chambers 10, and manifold channels (common liquid chambers) 11 are formed, and a piezoelectric actuator (energy imparting mechanism) 32 which is arranged on an upper surface of the channel unit 31, and which applies a pressure (imparts a discharge energy) to the ink in the pressure chambers 10.

The channel unit 31, as shown in FIG. 3 and FIG. 4, includes a cavity plate 21, a base plate 22, an aperture plate 23, two manifold plates 24 and 25, a damper plate 26, a spacer plate 27, and a nozzle plate 28, and these eight plates are joined in a stacked (layered) form. Except the nozzle plate 28, the seven plates 21 to 27 are formed of a metallic material such as stainless steel. Moreover, the ink channels such as the pressure chambers 10 and the manifold channels 11 are formed in these seven plates 21 to 27 by an etching. The nozzle plate 28 is formed of a synthetic resin material such as polyimide, and is joined to a lower surface of the spacer plate 27. A plurality of nozzles 17 corresponding to pressure chambers 10 is formed in the nozzle plate 28, by a laser machining (laser processing). The nozzle plate 28 may also be formed of a metallic material similar to the other plates 21 to 27.

As shown in FIG. 2 to FIG. 4, sixteen pressure chambers arranged in two rows of eight pressure chambers 10 in the paper feeding direction (vertical direction in FIG. 2) are formed in the cavity plate 21. Each of the pressure chambers 10 has a substantially elliptical shape with a longitudinal axis of the elliptical shape in the scanning direction. In the base plate 22, communicating holes 12 which communicate the pressure chambers 10 with apertures 13 and communicating holes which form a part of channels 14 communicating the pressure chambers 10 with the nozzles 15, are formed near both ends of the pressure chambers 10 in the longitudinal direction. In the aperture plate 23, the apertures 13 which communicate the communicating holes 12 with the manifold channels 11, and through holes which form a part of channels 15, are formed. The aperture 13 performs functions such as adjusting an amount of ink which flows into the pressure chambers 10 from the manifold channels 11, preventing a reverse flow of the ink from the pressure chambers 10 to the manifold channels 11, and suppressing a propagation of a pressure wave from the pressure chambers 10 to the manifold channels 11 when the pressure is applied to the ink in the pressure chambers 10 by the piezoelectric actuator 32. In this embodiment, connection ports 13*a* with the manifold channels 11 are formed at a lower end of the apertures 13.

Communicating holes which form an upper half portion of the manifold channels 11, and a part of the channels 14 are formed in the manifold plate 26, and communicating holes which form a lower half portion of the manifold channels 11, and a part of the channels 14 are formed in the manifold plate 27. The manifold channels 11 are formed by joining the manifold plate 26 and the manifold plate 27. Two manifold channels 11 are formed corresponding to the pressure chambers 10 arranged in two rows, and are extended in the paper feeding direction (direction of extension), which is a direction in which the pressure chambers 10 are arranged. The ink is supplied to the two manifolds channels 11 from ink inflow ports 9. The ink inflow ports 9 are formed near one end (upper side in FIG. 2) of the paper feeding direction except in an area of the channel unit 31 in which the piezoelectric actuator 32 is installed. Here, one ink inflow port 9 is provided for each of the manifold channels 11.

As shown in FIG. 2 to FIG. 4, each of the manifold channels 11 includes a first area 11*a* and a second area 11*b* extended in order from the ink inflow port 9, in the paper feeding direction. The first area 11*a* is extended in the paper feeding direction with almost constant width (length in the scanning direction, length in a direction orthogonal to the direction of extension in a plane parallel to a bottom surface of the manifold channel 11) $W_1$, and communicates with the corresponding pressure chambers 10 from the connection ports 13*a*, via the apertures 13. The second area 11*b* is connected to the first area 11*a* at an end on a side opposite to the ink inflow port 9. A width $W_2$ of the second area 11*b* is more than the width $W_1$ of the first area, and the second area 11*b* communicates with the channels 17 formed in the damper plate 26 which will be described later, via connection ports 17*a*. Here, the ink which has flowed in through the ink inflow port 9 flows to the first area 11*a*, and is jetted from the nozzles 15 upon being distributed to the pressure chambers 10 from the connection ports 13*a*. However, the ink hardly flows into near end portion of the manifold channel 11, which is at a position farthermost from the ink inflow port 9, and an air bubble is susceptible to be stagnated in this portion. When the communication ports 13*a* which communicate with the pressure chambers 10 are formed in this portion, an air bubble is susceptible to flow toward the pressure chambers 10, and jetting characteristics of the ink are changed due to this air bubble, which sometimes result in a decline in a printing quality. However, in this embodiment, the second area 11*b* is formed in this area and does not communicate with the pressure chambers 10 which contribute to jet of the ink. Instead, the channels 17 communicating with channels 18 which will be described above communicates, and for example, an arrangement is such that an air bubble which is susceptible to be stagnated at a time of inkflow, is discharged (drained). Moreover, even if air bubbles are accumulated during the use, the air bubbles are discharged easily from the channels 18 by a purge process.

A recess 16 is formed in a lower surface of the damper plate 26, at a portion overlapping with each of the manifold channels 11 (the first area 11*a* and the second area 11*b*), in a plan view. The portion of the damper plate 26 in which the recess 16 is formed is a thin-walled portion 26*a* having a thickness less than a thickness of the rest of the damper plate 26. Since an inside of the recess 16 is filled with air, a stiffness of the recess 16 is lower than a stiffness of the thin-walled portion 26*a*. Due to the deformation of the thin-walled portion 26*a*, the recess 16 and the thin-walled portion 26*a* function as a damper which attenuates a pressure wave in the manifold channel 11. The thin-walled portion 26 corresponds to a first thin-walled portion according to the present invention, and the recess 16 corresponds to a first damper chamber according to the present invention. Moreover, in this case, the first damper chamber is an air chamber which is filled with air.

Moreover, the channel 17 which makes the manifold channel 11, the communicating holes which form a part of the channels 14 and dummy nozzles 19 communicate are formed in the damper plate 26. The channels 17 communicate with the manifold channels 11, at the connection ports 17*a*, and have a reduced cross-sectional area of the channels between the manifold channels 11 and the channels 18. Furthermore, due to the channels 17, an amount of ink flowing from the manifold channel 11 to the channel 18 is controlled, and the ink does not flow out from the dummy nozzle 19.

The spacer plate 27 covers an opening of the recess 16 formed in the lower surface of the damper plate 26. The communicating holes which form a part of the channel 14, and the communicating holes (channels) 18 which communicate the channels 17 with the dummy nozzles (dummy discharge ports, second discharge ports) 19, are formed in the spacer plate 27. A plurality of nozzles 15 is formed in the nozzle plate 28, at positions overlapping with the channels 14, in a plan view, and a plurality of dummy nozzles is formed in the nozzle plate 28 at positions overlapping with the channels 18. When the nozzle plate 28 is formed of a synthetic resin material, it is possible to forms the nozzles 15 and the dummy nozzles 19 by an excimer laser process, and when the nozzle plate 28 is formed of a metallic material, it is possible to form the nozzles 15 and the dummy nozzles 19 by an etching process or a pressing process in which a punch is used.

As it has been described above, the manifold channels 11 communicate with the pressure chambers 10 via the communicating holes 12, the apertures 13, and the connection ports 13*a*, in the first area 11*a*, and the pressure chambers 10 communicate with the nozzles (first discharge ports) 15 via the channels 14. Moreover, the manifold channels 11 communicate with the dummy nozzles 19 via the channels 18, the channels 17, and the connection ports 17*a* in the second area 11*b*. Thus, a plurality of first individual ink channels from the connection port 13*a* with the manifold channel 11, up to the nozzle 15 via the pressure chamber 10, and a plurality of second individual ink channels from the connection port 17*a* with the manifold channel 11, up to the dummy nozzle 19 are formed in the channel unit 31. Here, in the first individual ink channels, since the channels 14 are adjacent to the manifold channel 11 with respect to the scanning direction, it is not possible to extend the first area 11*a* up to a portion overlapping with the channels 14 and the nozzles 15 in a plan view. Whereas, since the second individual ink channels are not adjacent to the manifold channels 11 with respect to the scanning direction, it is possible to extend the second area 11*b* up to a portion overlapping with the channels 17 and 18, and the dummy nozzles 19, in a plan view. In other words, since the channels 17 and 18, and the dummy nozzle 19 are accommodated in a range in which the second area 11*b* is formed, in a plan view, a degree of freedom of extension of the second area 11*b* is high. Consequently, as it has been mentioned above, it is possible to make the width $w_2$ of the second area 11*b* to be more than the width $W_1$ of the first area.

Next, the piezoelectric actuator 32 will be described below. As shown in FIG. 3 and FIG. 4, the piezoelectric actuator 32 includes eight piezoelectric layers 41 which are laminated (stacked) on the upper surface of the channel unit 31, and four common electrodes 43 and three individual electrodes 42 which are formed alternately between the eight piezoelectric layers 41 which are laminated.

The piezoelectric layer 41 is made of mainly lead zirconate titanate (PZT) which is a solid solution of lead titanate and lead zirconate, and is a ferroelectric substance. The lowermost piezoelectric layer 41 among the eight piezoelectric layers 41 is arranged continuously on an upper surface of the cavity plate 21 to cover all the pressure chambers 10, and is joined to the cavity plate 21. The other seven piezoelectric layers 41 are arranged on an upper surface of this lowermost piezoelectric layer 41. The piezoelectric layer 41 can be formed by an aerosol deposition in which, very fine particles of PZT are deposited on a surface of a substrate by spraying the particles on the substrate. Moreover, the piezoelectric layer 41 can also be formed by a method such as a sputtering, a chemical vapor deposition method (CVD method), a sol-gel method, and a hydrothermal synthesis method. Or, the piezoelectric layer can also be formed by cutting to a predetermined size a piezoelectric sheet which is obtained by baking a green sheet of PZT, and then by adhering this cut piezoelectric sheet.

The individual electrodes 42 and the common electrodes 43 are formed alternately among the laminated piezoelectric layers 41, in a portion facing the pressure chambers 10 in a plan view. Moreover, as shown in FIG. 3, the individual electrodes 42 and the common electrodes 43 are arranged to shift alternately with respect to a left and right direction in FIG. 3. One of the individual electrodes 42 and one of the common electrodes 43 which are arranged sandwiching one piezoelectric layer 41, correspond to a pair of electrodes according to the present invention. However, except the two common electrodes 43 which are arranged at the uppermost position and the lowermost position, the three individual electrodes 42 and two common electrodes 43 form pairs with each of electrodes which are arranged at the upper side sandwiching one piezoelectric layer 41 and at the same time, also form pairs with electrodes which are arranged at the lower side sandwiching another piezoelectric layer 41. In other words, each of these electrodes is in pair with two electrodes In other words, these electrodes are a part of two pairs of electrodes respectively.

Moreover, through holes 41*a* are formed in the seven piezoelectric layers 41 excluding the lowermost piezoelectric layer 41, at a portion overlapping with the individual electrodes 42 in a plan view, and not overlapping with the common electrodes 43 in a plan view, and an electroconductive material 44 is filled in the through holes 41*a*. Furthermore, through holes 41*b* are formed in these seven piezoelectric layers 41, at a portion overlapping with the common electrodes 43 in a plan view, and not overlapping with the individual electrodes 42, and an electroconductive material 45 is filled in the through holes 41*b*.

A flexible printed circuit (FPC) which is not shown in the diagram is arranged on an upper surface of the piezoelectric actuator 32, and the electroconductive materials 44 and 45, and the FPC are connected electrically. The FPC is connected to a driver IC which is not shown in the diagram. An electric potential of the three individual electrodes 42 is controlled by the driver IC via the FPC and the electroconductive material 44, and the four common electrodes 43 are kept at a ground electric potential all the time via the FPC and the electroconductive material 45.

Next, an action of the piezoelectric actuator 32 will be described below. When a predetermined electric potential is selectively applied by the driver IC to the individual electrodes 42 via the FPC, an electric potential difference is generated between the individual electrodes 42 to which the predetermined electric potential is applied, and the common electrodes 43 which are held at the ground electric potential, and an electric field in a direction of thickness acts on an area of the piezoelectric layers 41 which are sandwiched between the individual electrodes 42 and the common electrodes 43. Here, when a direction in which the piezoelectric layers 41 are polarized is same as the direction in which the electric field is generated, the piezoelectric layers 41 are elongated in the direction of thickness. Accordingly, a volume of the pressure chambers 10 are decreased, and a pressure on the ink in the pressure chambers 10 is increased. As the pressure on the ink in the pressure chamber 10 is increased, the ink is jetted from the nozzles 15 communicating with the pressure chambers 10. Here, in the piezoelectric actuator 32, since the eight piezoelectric layers 41 are laminated, and excluding the lowermost piezoelectric layer 41, each of the remaining seven piezoelectric layers 41 is elongated in the direction of thickness, it is possible to reduce sufficiently the volume of the pressure chambers 10.

At this time, due to the increase in the pressure inside the pressure chambers 10, a pressure wave is generated in a certain pressure chamber 10, and a part of the pressure wave generated is propagated to the manifold channel 11 which communicates with the pressure chamber 10 As the pressure wave is propagated to the manifold channel 11, the thin-walled portion 26*a* of the damper plate 26 which forms the bottom surface of the manifold channel 11, is deformed, and the pressure wave is attenuated.

Here, an effect of attenuation of the pressure wave in the manifold channel 11 is increased in direct proportion to an acoustic capacitance of the manifold channel 11. The acoustic capacitance of the manifold channel 11 is expressed by the following equation (1).

$$[V_p/(\kappa K_1)]+[\{l_d W_d^5(l-V_d^2))/\{60E_d t_d^3\}] \quad (1)$$

In equation (1), a first term means the acoustic capacitance of the manifold channel 11 and a second term means an increased acoustic capacitance by forming of the thin-walled portion 26*a*, where, $V_p$ is a volume of the manifold channel 11, κ is a stiffness coefficient (elastic modulus) of ink, $K_l$, is a correction coefficient which depends on a stiffness of a wall of the manifold channel 11, $l_d$ is length of the thin-walled portion 26*a* in the direction of paper feeding, Wd is a width (length in a left and right direction in FIG. 2) of the thin-walled portion 26*a*, Vd is Poisson's ratio of the thin-walled portion 26*a*, Ed is a stiffness coefficient of the thin-walled portion 26*a*, and $t_d$ is a thickness of the thin-walled portion 26*a*. An acoustic capacitance per unit length in the paper feeding direction is calculated by dividing this value by the length $l_d$ of the manifold channel 11, in the paper feeding direction. Consequently, the acoustic capacitance per unit length of the manifold channel 11 in the paper feeding direction is proportional to $V_p/l_d$, $W_d^5$, and $1/t_d^3$. In other words, wider an area of the manifold channel 11 in a direction orthogonal to the paper feeding direction, i.e. greater the width or a depth of the manifold channel 11, an acoustic capacitance of the manifold channel 11, per unit length in the paper feeding direction becomes more. Similarly, greater a width of the thin-walled portion 26*a*, or smaller a thickness of the thin-walled portion 26*a*, the acoustic capacitance per unit length of the manifold channel 11 in the paper feeding direction becomes more.

In this embodiment, the depth of the manifold channel 11 is constant but the width $W_2$ of the second area 11*b* is more than the width $W_1$ of the first area 11*a*. Consequently, the second area 11*b* has a greater acoustic capacitance per unit length in the paper feeding direction, than an acoustic capacitance per unit length of the first area 11*a*. In other words, in the second area 11*b*, it is possible to attenuate the pressure wave more efficiently than in the first area 11*a*.

According to the embodiment described above, since the width $W_2$ of the second area 11*b* is more than the width $W_1$ if the first area, the acoustic capacitance per unit length of the second area 11*b* in a direction of extension is more (greater) than the acoustic capacitance per unit length of the first area 11*a* in the direction of extension. Consequently, it is possible to attenuate the pressure wave more efficiently in the second area 11*b* than in the first area 11*a*. Accordingly, it is possible to prevent a generation of a cross-talk, where the cross-talk means changes of jetting characteristics of the ink jetted from the nozzle 15 when the pressure is applied to the ink in one of the pressure chambers 10 by the piezoelectric actuator 32, and the pressure wave which is generated in the pressure chamber 10 and propagated to the manifold channels 11 is propagated to another pressure chamber 10. Furthermore, such a cross-talk hardly occurs because the connection ports 14*a* (13*a*) which communicate with the pressure chambers 10 are not formed near an end portion of the manifold channel 11 on a side opposite to the ink inflow port 9 which is susceptible to be affected by the pressure wave, and the connection port 17*a* which communicates with the dummy nozzle 19 which does not jet the ink is formed near the end portion of the manifold channel 11 on the side opposite to the ink inflow port 9.

Moreover, since the thin-walled portion 26*a* which forms the wall surface of the manifold channel 11 is formed in the damper plate 26, the acoustic capacitance of the manifold channel 11 is increased further. Consequently, it is possible to attenuate the pressure wave efficiently in the manifold channel 11.

Furthermore, the ink is flowed assuredly into the pressure chamber 10 without the air bubble flowing therein because the communication ports 13*a* which communicate with the nozzles 15 are not formed near the end portion of the manifold channel 11 on the side opposite to the ink inflow port 9, to which the ink is hardly flowed through the ink inflow port 9, and the air bubble is susceptible to be stagnated, and the connection ports 17*a* which communicate with the dummy nozzles 19 which do not jet the ink are formed near the end portion of the manifold channel 11 on the side opposite to the ink inflow port 9. Consequently, it is possible to suppress an occurrence of unevenness in the jetting characteristics of the ink in the nozzles 15 which is caused due to an air bubble.

Next, modified embodiments in which various modifications are made in the embodiment will be described below. However, same reference numerals are used for components having a similar structure as in the embodiment, and the description of such components is omitted.

First Modified Embodiment

Figure 5:
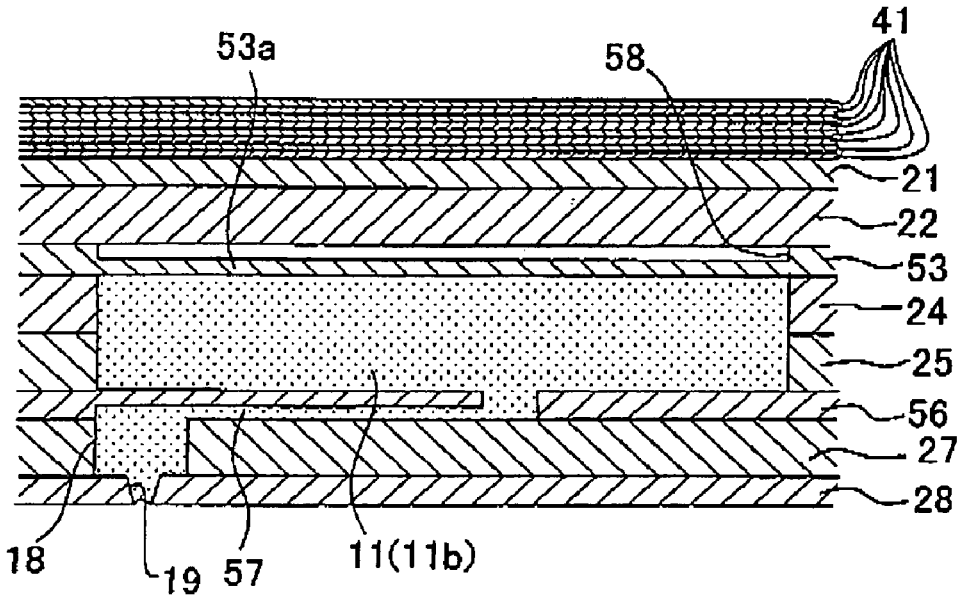
FIG. 5 is a cross-sectional view corresponding to FIG. 4 of a first modified embodiment.

A first modified embodiment is shown in FIG. 5. FIG. 5 is a cross-sectional view corresponding to FIG. 4 described above, of a section which is cut to include the dummy nozzle 19, in the second area 11*b*. In the first modified embodiment, a thin-walled portion 53*a* is formed by a recess 58 on an upper surface of an aperture plate 53, at a position overlapping with the second area 11*b* of the manifold channel 11, in a plan view. On the other hand, in an area of a damper plate 56 overlapping with the second area 11*b* in a plan view, no recess is formed, but a channel 57 which is extended in the scanning direction (left to right direction in FIG. 5) to be longer than the channel 17 (refer to FIG. 4) in the embodiment is formed. Since the aperture 13 is not formed in a portion of the aperture plate 53 overlapping with the second area 11*b*, in a plan view, it is possible to form the thin-walled portion 53*a* by forming the recess 58 in the aperture plate 53 in such manner. In other words, since a channel which regulates the formation of the recess 58 is not arranged in this area of the aperture plate 53, it is possible to form a recess 58*a* covering the entire second area 11*b*. In a structure in FIG. 4, in addition to the recess 16 (thin-walled portion 26*a*) the connection port 17*a* and the channel 17 are formed in the second area 11*b* in the damper plate 26, therefore, an area occupied by the recess 16 is limited. In the first modified embodiment, there is no such restriction, and an acoustic capacitance per unit length in the paper feeding direction in the second area 11*b* is higher (greater) than the acoustic capacitance in the embodiment. Consequently, it is possible to attenuate even more efficiently the pressure wave in the manifold channel 11. Moreover, in this case, since a recess is not formed in an area of the damper plate 56, overlapping with the second area 11*b* in a plan view, it is possible to make a length of the channel 57 in the scanning direction to be longer than the channel 17 (refer to FIG. 4) in the embodiment. Accordingly, an amount of ink flowing from the manifold channel 11 to the channel 18 is restricted, and the ink is not flowed out from the dummy nozzle 19.

Second Modified Embodiment

Figure 6:
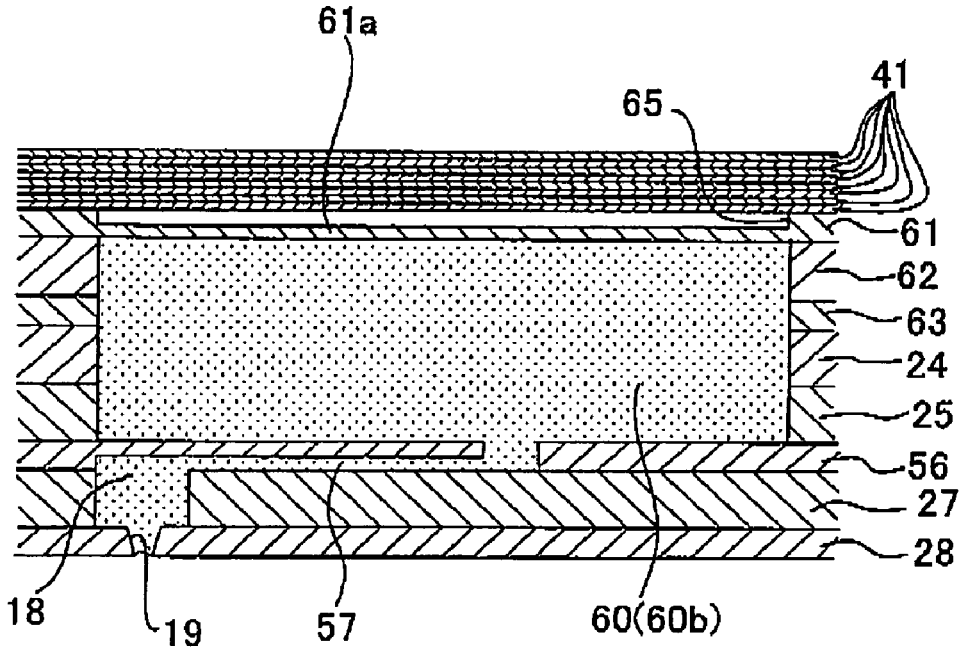
FIG. 6 is a cross-sectional view corresponding to FIG. 4 of a second modified embodiment.

A second modified embodiment is shown in FIG. 6. FIG. 6 is a cross-sectional view corresponding to FIG. 4 and FIG. 5 described earlier. In the second modified embodiment, a part of a second area 60*b* is formed in a base plate 62 and an aperture plate 63, and a thin-walled portion 61*a* is formed by forming a recess 65 in an area of an upper surface of a cavity plate 61, overlapping with a second area 60*b* in a plan view. Since channels such as the pressure chambers 10, the communicating holes 12, and the apertures 13 (refer to FIG. 13) are formed in a portion of the aperture plate 63, overlapping with the second area 60*b* in a plan view, it is possible to form a portion of the second area of a manifold channel 60 in the base plate 62 and the aperture plate 63, and also to form a thin-walled portion 61*a* by forming a recess 65 in the cavity plate 61. In this case, since a depth of the second area 60*b* becomes more (is increased), an acoustic capacitance per unit length in the paper feeding direction, of the second area 60*b* is increased (becomes higher). Consequently, it is possible to attenuate efficiently the pressure wave in the manifold channel 60.

Third Modified Embodiment

Figure 7:
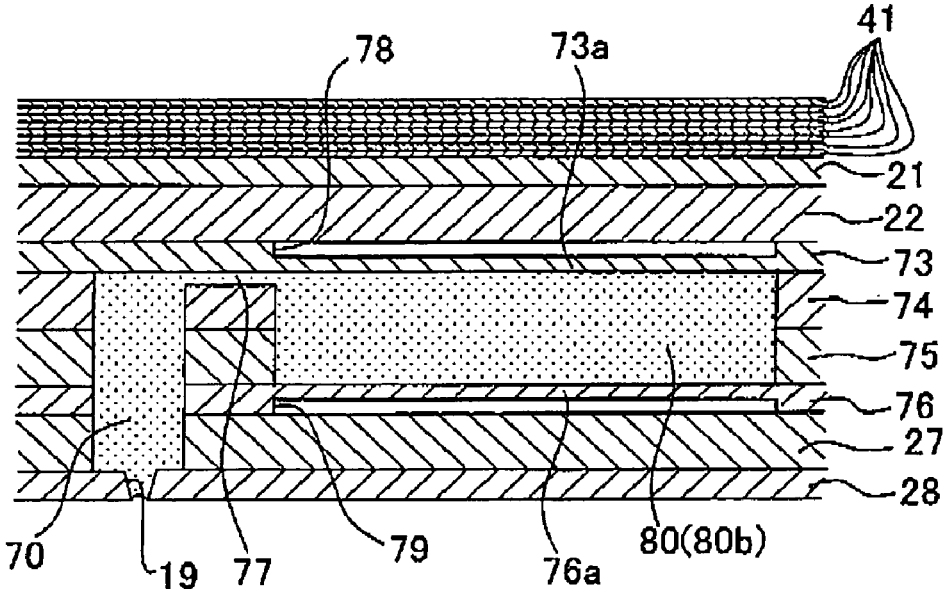
FIG. 7 is a cross-sectional view corresponding to FIG. 4 of a third modified embodiment.

As shown in FIG. 7, a thin-walled portion 76*a* is formed by forming a recess 78 in a portion of an upper surface of an aperture plate 73, overlapping with a second area 80*b* of a manifold channel 80 in a plan view, and a thin-walled portion 76*a* is formed by forming a recess 79 in a portion on a lower surface of a damper plate 76, overlapping with the second area 80*b* in a plan view. Further, channels 77 for communicating with the dummy nozzles 19 are formed in an upper portion of a first manifold plate 74 adjacent to the second area 80*b* in the scanning direction (left and right direction in FIG. 7). The channels 77 communicate with the second area 80*b* at an upper portion of the second area 80*b* unlike the channel 17 (refer to FIG. 4) in the embodiment. Moreover, in this case, through holes which are a part of channels 70 which make the channels 77 and the dummy nozzles 19 communicate, are formed in a portion of the first manifold plate 74, a second manifold plate 75, the damper plate 76, and the spacer plate 27, overlapping with the dummy nozzles 19 in a plan view. In the third modified embodiment, although a width of the second area 80*b* is decreased, since a thin-walled portion 76*a* and a thin-walled portion 73*a* which serve as a damper, form an upper wall surface and a lower wall surface respectively of the second area 80*b*, the acoustic capacitance in the second area 80*b* is increased. In this third modified embodiment, $W_d$ in equation 1 in the second area 80*b* is a total of a width of the thin-walled portion 73*a* and a width of the thin-walled portion 76*a*. Moreover, the thin-walled portions 76*a* and 73*a*, and the recesses 79 and 78 correspond to a first thin-walled portion, a second thin-walled portion, a first damper chamber, and a second damper chamber respectively.

Fourth Modified Embodiment

Figure 8:
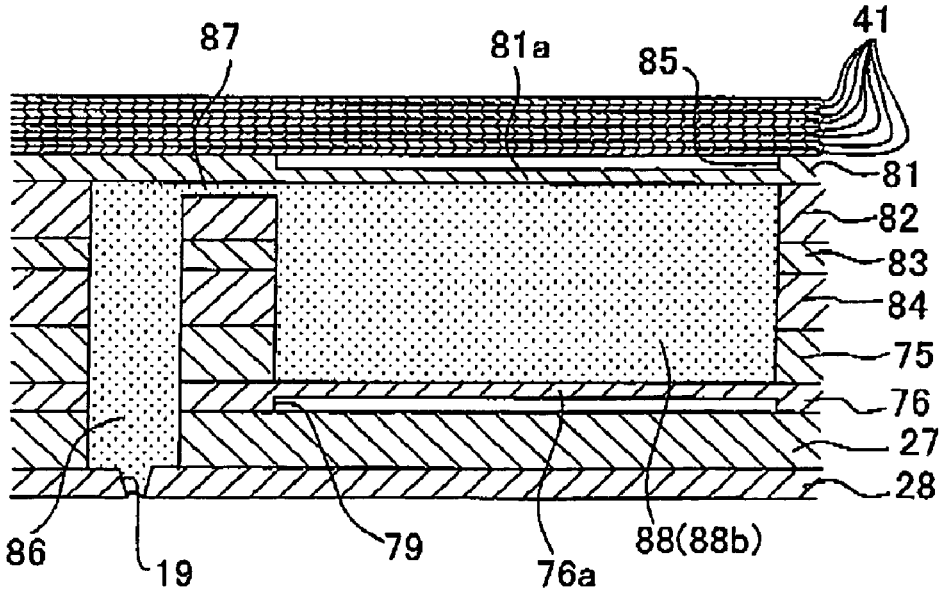
FIG. 8 is a cross-sectional view corresponding to FIG. 4 of a fourth modified embodiment.

As shown in FIG. 8, apart of a second area 88*b* of a manifold channel 88 is formed in a based plate 82 and an aperture plate 83, and channels 87 which make the second area 88b and the dummy nozzles 19 communicate, are formed in abase plate 82. Moreover, a thin-walled portion 81*a* is formed by forming a recess 85 in a portion of an upper surface of a cavity plate 81, overlapping with the second area 88*b* in a plan view. In this case, since the second area 88*b* has become deep due to forming of a part of the second area 88*b* in the base plate 82 and the aperture plate 83, the acoustic capacitance per unit length in the paper feeding direction of the second area 88*b* is becomes greater. In this case, in addition to a case of the third modified embodiment, communicating holes which form a part of channels 86 which make the channels 87 and the dummy nozzles 19 communicate, are formed in the base plate 82 and the aperture plate 83.

Fifth Modified Embodiment

Figure 9:
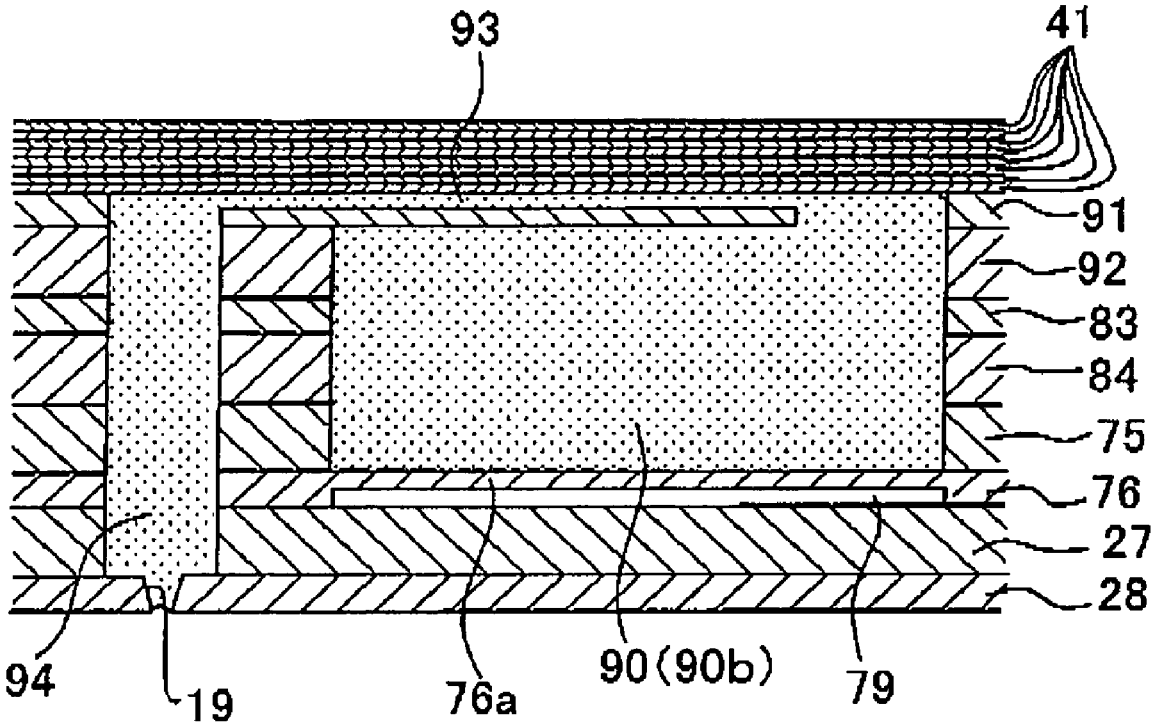
FIG. 9 is a cross-sectional view corresponding to FIG. 4 of a fifth modified embodiment.

As shown in FIG. 9, a part of a second area 90*b* of a manifold channel 90 is formed in a base plate 92 and an aperture plate 83, and channels 93 which make the second area 90*b* and the dummy nozzles 19 communicate are formed in a cavity plate 91. In this case, since a thin-walled portion (a thin-walled member) is not formed at an upper portion of the second area, it is possible to have a greater length in the scanning direction (left and right direction in FIG. 9), of the channels 93, and a flow of ink from the manifold channels 90 to the dummy nozzles 19 is restricted assuredly, and the ink is not flowed out assuredly from the dummy nozzles 19. In this case, communicating holes which form a part of channels 94 which make the channels 93 and the dummy nozzles 19 communicate are formed in the cavity plate 91 and the base plate 92.

Sixth Modified Embodiment

Figure 10:
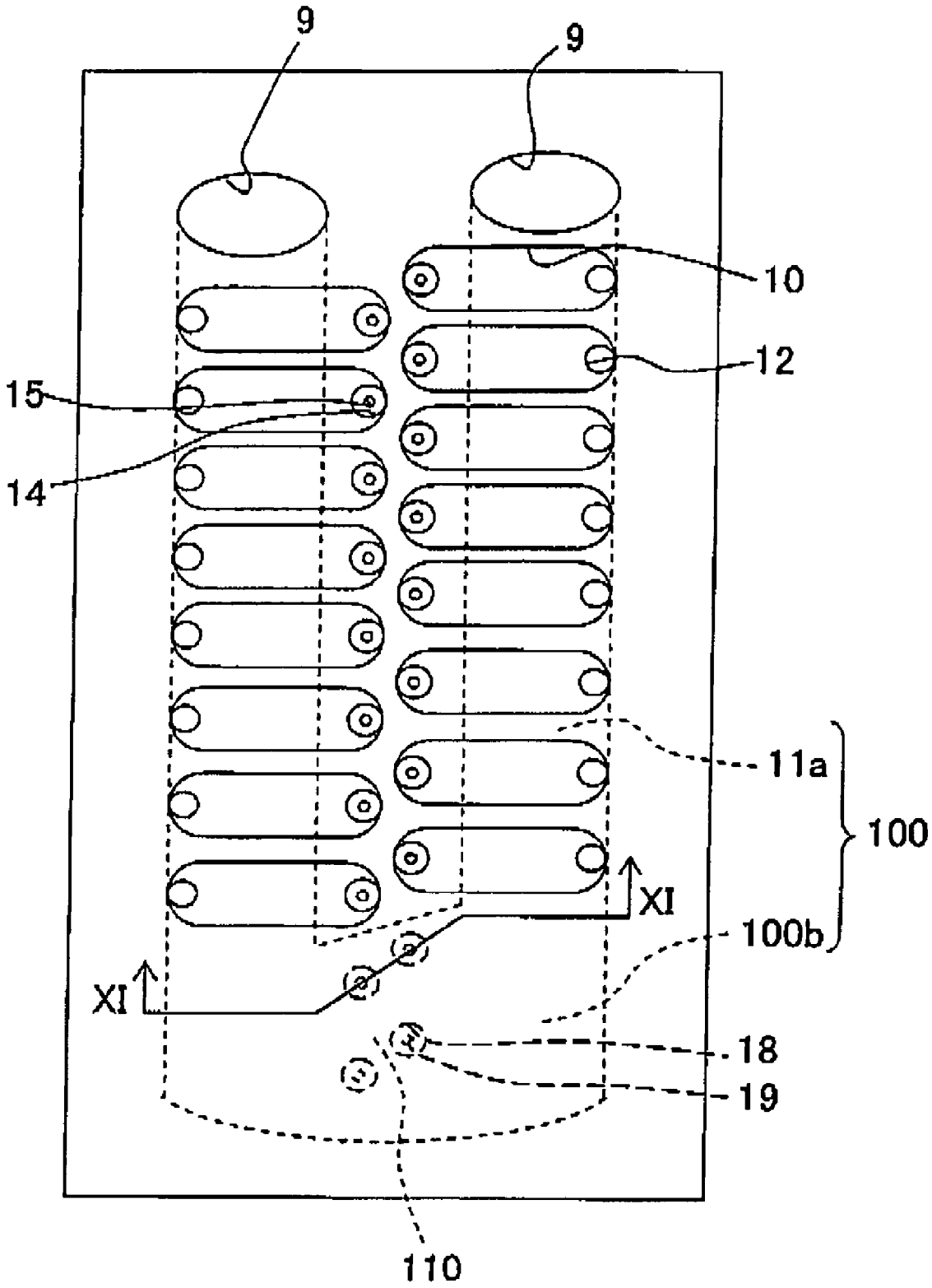
FIG. 10 is a cross-sectional view corresponding to FIG. 2 of a sixth modified embodiment.
Figure 11:
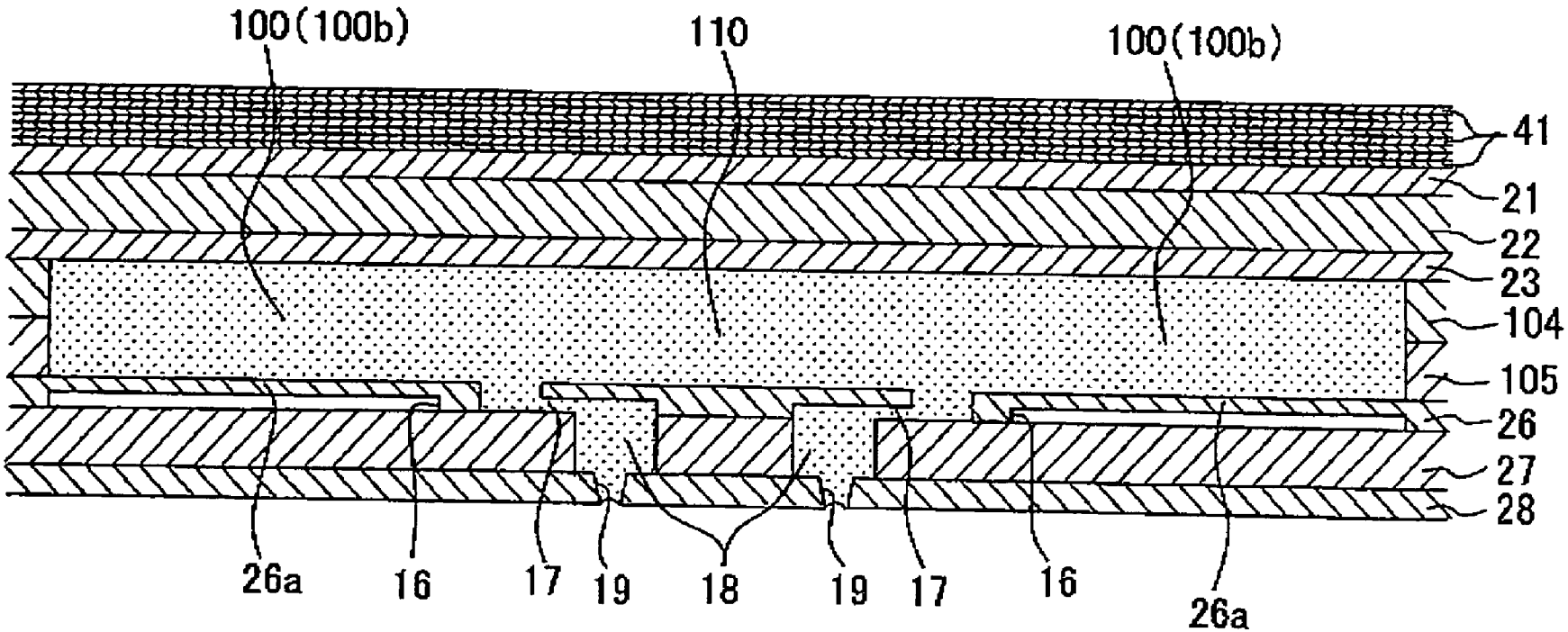
FIG. 11 is a cross-sectional view taken along a line XI-XI in FIG. 10.

As shown in FIG. 10 and FIG. 11, a connecting channel 110 which makes second areas 100*b* of the two manifold channels 100 communicate is formed in a manifold plate 104 and a manifold plate 105. Then the ink filled in the two manifold channels 100 are the same. In this case, since the two second areas 100*b* are communicated by the connecting channel 110, it is possible to attenuate the pressure wave efficiently in the manifold channel 100 by the two second areas 100*b* and the connecting channel 110.

Seventh Modified Embodiment

Figure 12:
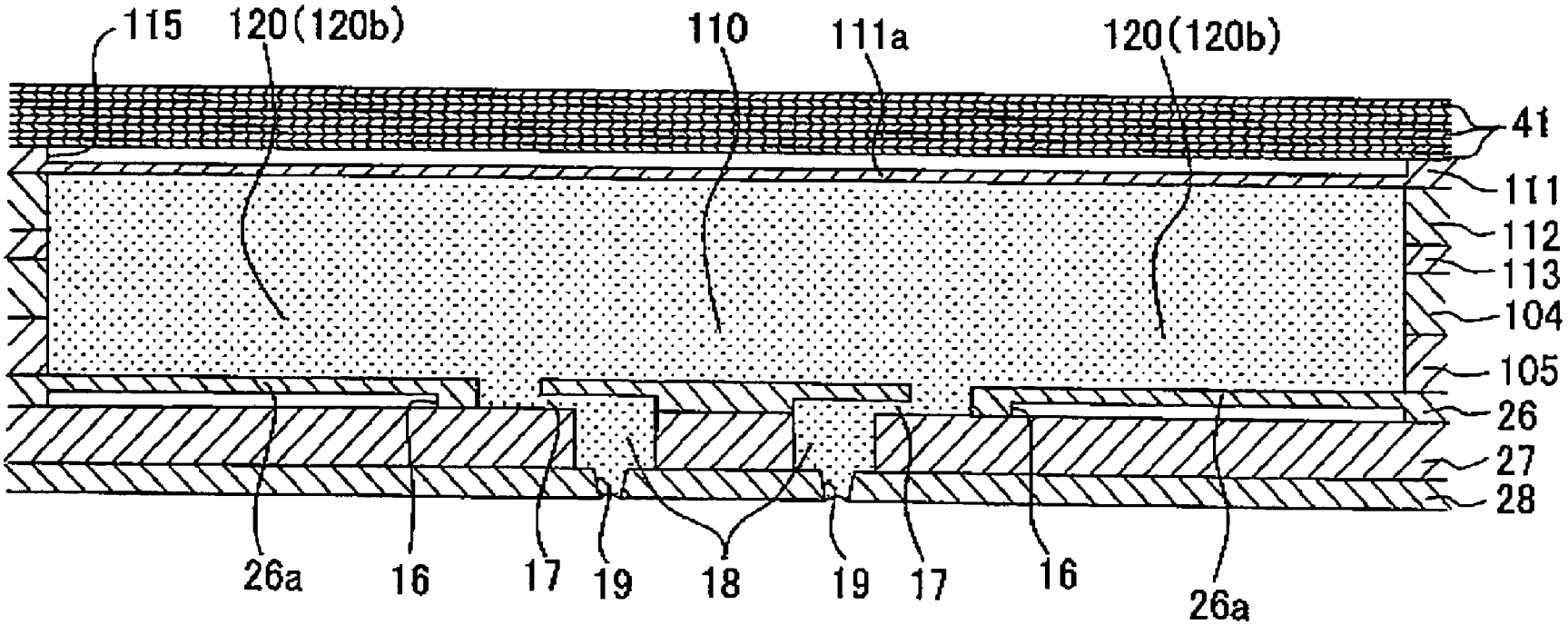
FIG. 12 is a cross-sectional view corresponding to FIG. 11 of a seventh modified embodiment.

As shown in FIG. 12, a part of a connecting channel 130 and a part of a second area 120*b* of a manifold channel 120 is formed in a base plate 112 and an aperture plate 113, and a thin-walled portion 111*a* is formed by forming a recess 115 on an upper surface of a cavity plate 111 at a position overlapping with a communicating channel 130 and the second area 120 in a plan view. In this case, since a part of the communicating channel 130 and the second area 120*b* are formed in the base plate 112 and the aperture plate 113, an acoustic capacitance per unit length in a direction of extension (left and right direction in FIG. 12) in the connecting channel 130 is increased by increasing a depth of the connecting channel 130 and the second area 120*b*. Consequently, it is possible to attenuate the pressure wave efficiently in these areas. Moreover, since a part of a wall surface of the communicating channel 130 is formed by a thin-walled portion 111*a*, the acoustic capacitance of the connecting channel 130 becomes higher (greater). Consequently, it is possible to attenuate the pressure wave even more efficiently in the connecting channel 130. The thin-walled portion 111*a* and a portion of the recess 115 overlapping with the connecting channel 130 in a plan view, correspond to a third thin-walled film and a third damper chamber according to the present invention respectively. Even in the seventh embodiment, a recess corresponding to the recess 115 may be formed in the base plate 112 or the aperture plate 113 such that a thin-walled portion of the recess forms a part of a wall portion (surface) of the manifold channel, according to a form of the manifold channel, as it has been described above, and a similar effect can be achieved, Furthermore, as in the seventh embodiment, when the piezoelectric actuator includes the connecting channel 130, a recess may be formed in the base plate 112 and the aperture plate 113 for ensuring a stiffness of a lower portion of the piezoelectric actuator.

In the embodiment described above, the piezoelectric actuator 6 has been an actuator in which a piezoelectric longitudinal effect is used. However, the piezoelectric actuator is not restricted to this type of piezoelectric actuator. For example, the piezoelectric actuator may be a unimorph actuator combined (assembled) with a vibration plate, in which a piezoelectric transverse effect is used. In this case, when the vibration plate is electroconductive, a pair of electrodes is formed by the vibration plate which functions as a common electrode and one of individual electrodes, the pair of electrode is arranged to face mutually and to sandwich a piezoelectric layer there between. When the vibration plate is non-conductive, a common electrode maybe provided on the non-conductive, vibration plate. Moreover, a pair of electrodes may be formed for each pressure chamber, on a surface of the piezoelectric layer, and the actuator may be let to be an actuator in which a plurality of piezoelectric layers with the electrodes stacked thereon. In this case, a slip deformation is caused to occur by making directions of an electric field and polarization to intersect.

Moreover, a gas such as air, nitrogen, oxygen, helium, and carbon dioxide may be filled in the damper chamber. However, if the thin-walled portion is not eroded or deteriorated, a liquid may be filled in the damper chamber instead of a gas. Furthermore, according to a required damper performance, a porous resin having holes therein, such as a sponge member may be filled in.

In each embodiment, the ink inflow port, and the first area and the second area were arranged in almost the paper feeding direction. However, embodiments are not necessarily restricted to embodiments with such arrangement, and the second area may also be provided on both sides of the direction of extension of the first area, provided that the ink inflow port communicates from a side of the first area which is extended to be long. It is needless to mention that for an ink-jet head in which a plurality of manifolds is arranged, a connecting channel which connects the second areas may be provided further on both side.

In the embodiment of the present invention, a description was made by taking an in ink-jet head of a serial type as an example. However, the present invention is also applicable to an ink-jet head of a line type. In the embodiment of the present invention, an energy imparting mechanism was described by taking an example of a piezoelectric actuator. However, an example of a mechanism which discharges ink by imparting a thermal energy to a liquid may be taken. Moreover, in the embodiment of the present invention, an example in which the present invention is applied to an ink-jet head is described. However, the present invention is also applicable to a liquid droplet jetting apparatus which jets liquid other than ink such as a reagent, a biomedical solution, a wiring material solution, an electronic material solution, for a cooling medium (refrigerant), and for a fuel.

What is claimed is:

1. A liquid droplet jetting apparatus which jets a droplet of a liquid, comprising:

a channel unit including a common liquid chamber which is long in an extending direction and which has a first area and a second area, the first area having a liquid inflow port through which the liquid flows in, and a plurality of first connection ports through which the liquid flows out, the second area having a second connection port which is formed on a side opposite to the liquid inflow port with respect to the first connection ports; a plurality of pressure chambers communicating with the common liquid chamber; a plurality of first discharge ports communicating with the pressure chambers; a second discharge port communicating with the common liquid chamber; a plurality of first individual liquid channels each ranging from one of the first connection ports of the common liquid chamber up to one of the first discharge ports via one of the pressure chambers; and a second individual liquid channel ranging from the second connection port up to the second discharge port; and an energy imparting mechanism which imparts a discharge energy to the liquid in the pressure chambers:

wherein an acoustic capacitance of the second area per unit length along the extending direction is greater than an acoustic capacitance of the first area per unit length.

2. The liquid droplet jetting apparatus according to claim 1, wherein a length of the second area in a direction orthogonal to the extending direction is greater than a length of the first area in the direction orthogonal to the extending direction in a plane parallel to a bottom surface of the common liquid chamber.

3. The liquid droplet jetting apparatus according to claim 1, wherein the second individual liquid channel overlaps entirely with the second area of the common liquid chamber in a plane parallel to a bottom surface of the common liquid chamber.

4. The liquid droplet jetting apparatus according to claim 1, wherein a wall surface which defines the second area of the common liquid chamber is formed by a first thin-walled portion, and the channel unit further includes a first damper chamber, of which a part of a wall surface is formed by the first thin-walled portion, and which has a stiffness lower than a stiffness of the first thin-walled portion.

5. The liquid droplet jetting apparatus according to claim 4, wherein a wall surface, of the second area, facing the first thin-walled portion is formed by a second thin-walled portion, and the channel unit further includes a second damper chamber, of which a part of a wall surface is formed by the second thin-walled portion, and which has a stiffness lower than a stiffness of the second thin-walled portion.

6. The liquid droplet jetting apparatus according to claim 1, wherein a length of the second area in the direction orthogonal to a bottom surface of the common liquid chamber is greater than a length of the first area.

7. The liquid droplet jetting apparatus according to claim 1, wherein a cross-sectional area of the second area is greater than a cross-sectional area of the first area with respect to a surface orthogonal to the extending direction.

8. The liquid droplet jetting apparatus according to claim 1, wherein the common liquid chamber includes a first liquid chamber and a second liquid chamber, the first liquid chamber and the second liquid chamber each having the first area and the second area; and the channel unit further includes a connecting channel which connects the second area of the first liquid chamber and the second area of the second liquid chamber at a portion of each of the first chamber and the second chamber on a side opposite to the liquid inflow port with respect to the first area.

9. The liquid droplet jetting apparatus according to claim 8, wherein a wall surface of the connecting channel is formed by a third thin-walled portion, and the channel unit further includes a third damper chamber, of which a part of a wall surface is formed by the third thin-walled portion, and which has a stiffness lower than a stiffness of the third thin-walled portion.

10. The liquid droplet jetting apparatus according to claim 1, wherein the energy imparting mechanism includes a piezoelectric layer facing the pressure chamber, and pairs of electrodes which apply an electric field to the piezoelectric layer to change a volume of the pressure chambers, respectively.

11. The liquid droplet jetting apparatus according to claim 1, wherein the second discharge port is a dummy discharge port which jets no droplet of the liquid.

12. The liquid droplet jetting apparatus according to claim 4, wherein a length of the second area with respect to a direction orthogonal to the extending direction is same as a length of the first thin-walled portion in a plane parallel to a bottom surface of the common liquid chamber.

13. The liquid droplet jetting apparatus according to claim 5, wherein a length of the second area with respect to a direction orthogonal to the extending direction is same as a length of the second thin-walled portion in a plane which is parallel to a bottom surface of the common liquid chamber.

14. The liquid droplet jetting apparatus according to claim 13, wherein a length of the first thin-walled portion with respect to a direction orthogonal to the extending direction is same as the length of the second thin-walled portion in the plane parallel to the bottom surface of the common liquid chamber.

15. An ink-jet printer which performs printing by jetting an ink onto an object, comprising;

a transporting mechanism which transports the object in a predetermined direction and an ink-jet head including a channel unit which includes a common liquid chamber which is long in a extending direction, and which has a first area and a second area, the first area having a liquid inflow port through which the liquid flows in, and a plurality of first connection ports through which the liquid flows out, the second area having a second connection port which is formed on a side opposite to the liquid inflow port with respect to the first connection ports; a plurality of pressure chambers communicating with the common liquid chamber; a plurality of first discharge ports communicating with the pressure chambers; a second discharge port communicating with the common liquid chamber; a plurality of first individual liquid channels each ranging from one of the first connection ports of the common liquid chamber up to one of the first discharge ports via one of the pressure chambers; and a second individual liquid channel ranging from the second connection port up to the second discharge port: and an energy imparting mechanism which imparts a discharge energy to the liquid in the pressure chambers wherein an acoustic capacitance of the second area per unit length along the extending direction is greater than an acoustic capacitance of the first area per unit length.

16. The ink-jet printer according to claim 15, wherein a length of the second area in a direction orthogonal to the extending direction is greater than a length of the first area in the direction orthogonal to the extending direction in a plane parallel to a bottom surface of the common liquid chamber.

17. The ink-jet printer according to claim 15, wherein a wall surface which defines the second area of the common liquid chamber is formed by a first thin-walled portion, and the channel unit further includes a first damper chamber, of which a part of a wall surface is formed by the first thin-walled portion, and which has a stiffness lower than a stiffness of the first thin-walled portion.

18. The ink-jet printer according to claim 17, wherein a wall surface, of the second area, facing the first thin-walled portion is formed by a second thin-walled portion, and the channel unit further includes a second damper chamber, of which a part of a wall surface is formed by the second thin-walled portion, and which has a stiffness lower than a stiffness of the second thin-walled portion.

* * * * *